United States Patent [19]

Cooper

[11] 4,306,268

[45] Dec. 15, 1981

[54] ELECTROMAGNET CONTROL CIRCUIT

[75] Inventor: John P. Cooper, Menomonee Falls, Wis.

[73] Assignee: Square D Company, Palatine, Ill.

[21] Appl. No.: 83,033

[22] Filed: Oct. 9, 1979

[51] Int. Cl.[3] ..... H01F 13/00; H01F 7/20

[52] U.S. Cl. ..... 361/144; 361/149; 361/159

[58] Field of Search ..... 361/143, 144, 149, 159

[56] References Cited

U.S. PATENT DOCUMENTS

| | | | |
|---|---|---|---|
| 3,629,663 | 12/1971 | Butkus | 361/144 |
| 3,723,825 | 3/1973 | DeViney | 361/144 |
| 3,859,571 | 1/1975 | Strobl et al. | 361/144 |

FOREIGN PATENT DOCUMENTS

| | | | |
|---|---|---|---|
| 2107903 | 8/1972 | Fed. Rep. of Germany | 361/144 |
| 1065147 | 4/1967 | United Kingdom | 361/144 |

*Primary Examiner*—J. D. Miller
*Assistant Examiner*—L. C. Schroeder
*Attorney, Agent, or Firm*—Michael J. Femal

[57] ABSTRACT

A circuit for controlling operation of an electromagnet includes a source of voltage connectable to the electromagnet to produce current flow in one direction and develop a magnetic force therein. A dissipating circuit is connectable to the electromagnet to form a closed loop and has impedance means for dissipating stored energy with gate means between the closed loop and the source producing current flow from the source through the closed loop when the residual potential drops to the potential of source and produce reverse current flow through the magnet. The circuit also has a reverse current limiting means in parallel with the impedance means and includes a manually variable resistor to adjust the limit of reverse current flow.

12 Claims, 2 Drawing Figures

230V D.C.
10
MAGNET
20
12
14
16
18
22
24
26
28
30
32
34
38
40
42
44
50
51
52
54
56
58
60
62
64
70
72
74
76
78
82
84
86
88
90
92
93
94
96
98
99
100
110
112
120
130
140
142
144
150

MAGNET
18
20
24
26
28
30
32
34
43
44
50
51
52
54
56
58
64
72
74
76
78
82
84
88
90
92
93
94
96
98
110
112
120
130
140
142
144
150

ELECTROMAGNET CONTROL CIRCUIT

TECHNICAL FIELD

The present invention relates generally to control systems and, more particularly, to control means for automatically controlling the energization or magnetization of electromagnets and removing residual magnetism therefrom by reversing current flow through the electromagnet.

One of the most common uses for electromagnets is in the ferrous metal industry wherein ferrous materials having magnetic properties are picked up by an electromagnet and are transported to another site where they are dropped. In such an operation, the electromagnet must be energized in order to attract the material thereto and subsequently must be de-energized when the material is to be deposited.

In the operation of lifting electromagnets, direct current is usually supplied for energizing the magnet through connection of a voltage source across the magnet and this voltage source is interrupted to break the circuit to the magnet. After the circuit has been interrupted, it has become customary to remove residual magnetism that ordinarly remains in the magnet with the current is discontinued by providing a reverse current at a lower magnitude to the magnet to reverse the polarity thereof.

BACKGROUND PRIOR ART

Various types of control circuits have been developed for energizing an electromagnet for a lifting operation and then automatically applying a reverse current to the magnet after the residual magnetism or potential has been removed and thereafter discontinuing the application of the reverse current. One such control circuit is illustrated in Wertz U.S. Pat. No. 2,181,539. The circuit disclosed therein includes a non-linear resistor known in the industry under the trade name of "Thyrite" which has the property of decreasing its ohmic resistance as the potential across the resistor decreases. This type of control circuit has the advantage of reducing the time required for removing the residual magnetism or potential at the end of a lifting operation and produce reverse current flow to release the material being transported.

Another type of control circuit for an electromagnet is disclosed in Griffes U.S. Pat. No. 3,154,723 wherein a non-linear circuit or resistor is again utilized for reducing the residual potential in the magnet at the end of a lifting operation and also includes an automatic reversal of current flow when the residual potential in the electromagnet drops below a predetermined level.

One of the areas that has received a large amount of attention in electromagnet controllers is to reduce the time involved for reversing the current flow within the magnet. It will be appreciated that when an electromagnet is associated with a crane, which is the normal lifting unit, the crane is being utilized constantly for transporting the material from one site to another. It is also important that all of the material be cleanly removed or dropped at the end of a lifting cycle to reduce the time and attention of the operator.

SUMMARY OF THE INVENTION

According to the present invention, a control circuit for an electromagnet for use in a lifting and transporting operation for a magnetic material includes a voltage source for producing current flow through the electromagnet with a first or lifting circuit connectable to the voltage source to produce current flow in one direction through the electromagnet and develop potential therein for a lifting operation. The circuit also includes a second circuit that is connectable to the electromagnet to form a closed loop with the electromagnet and dissipate residual potential in the electromagnet at the end of a lifting cycle. The second or drop circuit is initially isolated from the source of voltage until such time as the residual potential in the second circuit drops to the level of potential in the voltage source. The voltage source is then connected through the second or isolated circuit to maintain the voltage across the electromagnet at an elevated value and continue the reduction of the residual potential in the electromagnet. The circuit also includes means for automatically reversing the current flow through the magnet when the residual potential therein drops below a predetermined value and is automatically disconnected from the source when the dissipating circuit or current flow through the electromagnet is at a predetermined value in the opposite direction.

More specifically, the second or dissipating circuit includes a plurality of series-connected fixed impedance means as well as a variable impedance parallel circuit across at least one of the fixed impedance means with control relay means therein which controls the de-energization of the drop circuit when the current flow reaches a certain level in the reverse direction.

The circuit also includes indicator means for indicating the condition of the discharge or dissipating circuit during the lifting operation and is also an indicator to indicate the optimum adjustment of the variable impedance means which produces reverse current flow.

BRIEF DESCRIPTION OF SEVERAL VIEWS OF DRAWINGS

FIG. 1 shows the control circuit of the present invention for an electromagnet used in a crane lifting operation; and, FIG. 2 is a view similar to FIG. 1 showing the direction of current flow at the end of the lift cycle to cancel the stored energy from the electromagnet.

DETAILED DESCRIPTION

Figure 1:
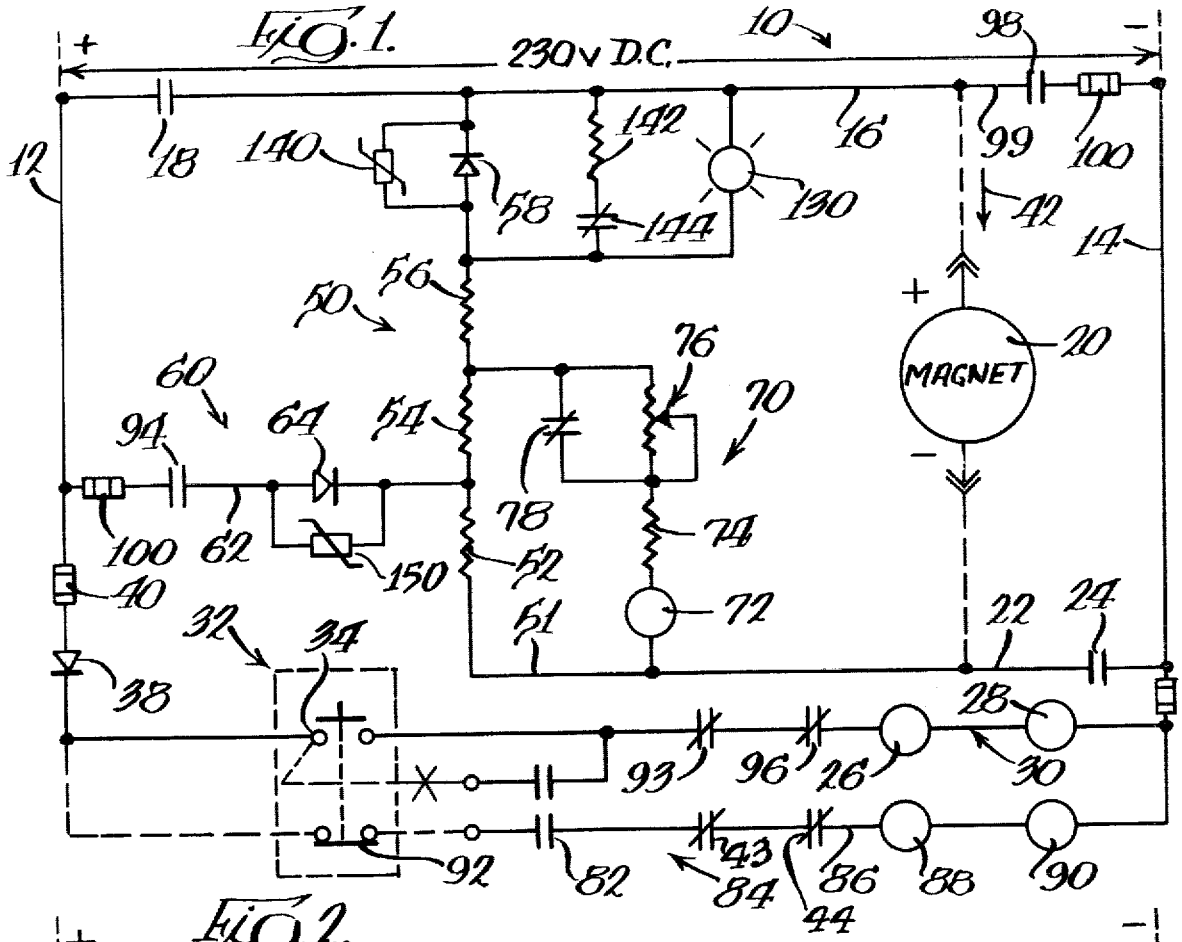

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses a control circuit, generally designated by reference numeral 10, having the features of the present invention incorporated therein. Control circuit 10 includes a pair of conductors 12 and 14 defining a voltage source of 230 VDC for producing current flow. A first or lifting circuit is located between conductors 12 and 14 and includes a first conductor 16 having a set of normally open contacts 18 therein and leading from conductor 12 to one (upper) side of an electromagnet 20. The first or lifting circuit also includes a further conductor 22 with a set of normally open contacts 24 leading from the opposite (lower) side of magnet 20 to conductor 14.

First and second normally open contacts 18 and 24 define normally open contact means that are closeable to produce current flow from conductor 12 through magnet 20 to conductor 14 to develop potential in the electromagnet for a lifting operation. Closure of normally open contacts 18 and 24 is produced by first and second contactors 26 and 28 located in a lifting circuit 30 connected between conductors 12 and 14. A master switch 32 has a set of normally open lifting contacts 34 located in lifting circuit 30 which also includes a rectifier 38 and a fuse 40. Contactors 26 and 28 also each have a set of normally closed contacts 43 and 44 in "drop" circuit 84 to be described later.

Thus, movement of master switch 32 will complete the circuit through two contactors 26 and 28 and close normally open contacts 18 and 24. Closure of the contacts 18 and 24 will produce current flow through the electromagnet 20 in the direction indicated by arrows 42 in FIG. 1. This will result in development of magnetic force within magnet 20 until the lifting cycle is interrupted by opening contacts 18 and 24. At the end of the lifting cycle, a certain amount of stored energy or magnetism will be maintained within the magnet 20 which must be rapidly dissipated to reverse the cycle of operation and drop the material from the electromagnet.

According to the present invention, this is accomplished by a dissipating or second circuit 50 that is connectable to form a closed loop with electromagnet 20 to automatically dissipate the stored energy within electromagnet 20 and then produce reverse current flow when the stored energy in the magnet drops below a certain level. As will be explained, the closed loop for the reverse current flow can be traced from the lower (second) side of electromagnet 20.

As illustrated in FIG. 1, the dissipating or shunting circuit 50 includes diode 58 connected to conductor 16 and its anode connected to the series resistors 52, 54 and 56 connected through lead 51 to the other side of electromagnet 20.

An isolating circuit 60 also forms part of dissipating circuit 50 and includes a conductor 62 leading from voltage source conductor 12 to the junction of resistors 52 and 54. The isolating means 60 includes a diode or rectifier 64 that prevents current flow from the dissipating circuit 50 to conductor 12 when the residual potential in the dissipating circuit remains above the level of potential of the voltage source. The dissipating or second circuit 50 also incorporates circuit 70 in parallel with at least one of the resistors and in the specific embodiment illustrated, is in parallel with first and second fixed resistors 52 and 54. Parallel circuit 70 is designed to produce an automatic reversal of current flow when the residual potential in magnet 20 drops below a certain level and also automatically interrupts the reverse current flow to interrupt the "drop" circuit 84 when the reverse current flow reaches a certain level.

Parallel circuit 70 includes a control relay 72 in series with a fixed resistor 74 and a variable resistor 76 which is preferably manually adjustable, as will be described later. Control relay 72 has a set of normally closed contacts 78 that are in parallel with variable resistor 76 and a set of normally open contacts 82 in the drop circuit 84.

The "drop" circuit 84 includes a conductor 86 and a pair of contactors 88 and 90 that are in series with a set of normally closed contacts 92 in master switch 32. First drop contactor 88 has a set of normally closed contacts 93 in conductor or lift circuit 30 and a set of normally open contacts 94 in cnductor 62 which forms part of isolating means 60. Likewise, second drop contactor 90 has a set of normally closed contacts 96 in lift circuit 30 and also a set of normally open contacts 98 in a conductor 99 connected between conductor 16 and conductor 14. Suitable fuses 100 may be located at the desired locations for circuit protection reasons.

Considering now the operation of the circuit so far decribed, when master switch 32 is placed in the lift position, contacts 34 will be closed to complete a circuit to lift contactors 26 and 28, which will respectively close contacts 18 and 24 to complete the first circuit between conductors 12 and 14 and produce current flow through magnet 20 in the direction illustrated by the arrow 42 in FIG. 1 and contacts 43 and 44 are opened in drop circuit 84. As current flow from conductor 12 to conductor 14 continues, a magnetic field that will attract the magnetic material to the electromagnet is developed.

At the end of the lift cycle, the lift circuit is interrupted and the drop circuit 84 is completed by closing contacts 92 and opening contacts 34, de-energizing 26 and 28 and opening contacts 18 and 24 while closing contacts 43 and 44. The stored energy within electromagnet 20 will induce a current flow in the direction indicated by the solid arrows 110 in FIG. 2 of the drawings and diode 58 will become forward biased to begin dissipation of the stored energy within electromagnet 20. At the same time, the voltage drop across fixed resistors 52 and 54 will also produce current flow through circuit 70, as represented by the arrow 112 in FIG. 2, to energize control relay 72 which, in turn, will open contacts 78 and close contacts 82 in the drop circuit 84 energizing 88 and 90, closing contacts 94 and 98, connecting the magnet to the voltage source with a polarity opposite to the lift direction. At this point, the voltage in the dissipating circuit 50 is substantially higher than the source of voltage. By comparison, the voltage in dissipating circuit 50 may be on the order of 800–1000 volts while the voltage source is at a level of approximately 230 volts DC.

The residual potential or voltage within the dissipating circuit 50 is substantially higher than the voltage source. However, rectifier or isolating diode 64 will prevent current flow from the dissipating circuit to conductor 12 and the big advantage of not discharging a high voltage back into the line conductor 12 is that voltage sensitive devices, such as pilot lights and the like which may be attached to the line conductor 12, will not burn out by receiving this high voltage spike. Thus, the dissipating circuit 50 is totally isolated from discharging into the positive line of the source. The stored energy within electromagnet 20 is thus rapidly reduced by the current flow through fixed resistors 52, 54 and 56. When the voltage at the junction of resistors 52 and 54 reaches the level of the voltage source, diode 64 will become forward biased and will maintain a voltage across the electromagnet 20 at a value of at least 230 volts. This level of voltage in the dissipating circuit 50 will result in maintaining a high rate of energy dissipation or residual potential dissipation across electromagnet 20. At the same time, control delay 72 will remain energized through current flow therethrough, as indicated by the solid arrow 112 in FIG. 2 of the drawings. Stated another way, the voltage drop across fixed resistors 52 and 54 will maintain a current flow through control relay 72 as the stored energy within electromagnet 20 continues to drop and ultimately reaches a level of approximately 230 volts, at which time current flow reversal will occur as will be explained later.

Figure 2:
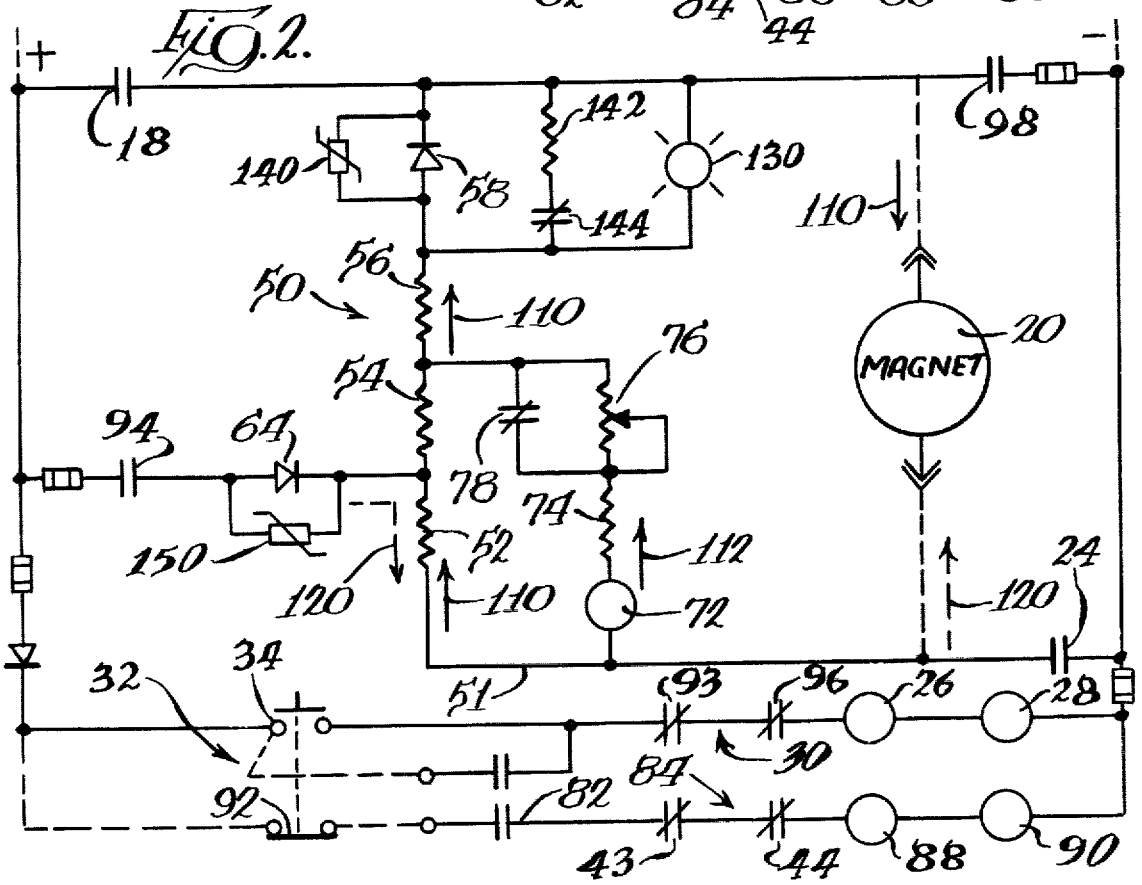

When the stored energy within electromagnet 20 reaches approximately 230 volts, a reversal of current flow will occur, as indicated by the phantom line arrows 120 in FIG. 2. At the same time, some of the current flow will be through the fixed resistors 54 and 56. Since the voltage at the juncture between resistors 54 and 56 is lower than the voltage in conductor 51, the current flow through relay 72 and resistor 52 will continue. Reverse current is initially low causing a low drop across resistor 52. Drop across resistor 54 is enough to hold relay 72 picked up. As the reverse current flow through electromagnet 20 increases, the voltage drop across resistor 52 increases, subtracting from voltage across resistor 54. Voltage on control relay 72 decreases until the "drop-out" voltage, established by adjustment of variable resistor 76, is reached, at which point the control relay 72 becomes de-energized to interrupt the drop circuit by opening contacts 82. At the same time, contacts 78 will close to condition the circuit for a subsequent lifting operation.

The advantage of this arrangement is that the desired value of reverse current can readily be set by manual adjustment of variable resistor 76 to bring the residual potential in magnet 20 down to zero rapidly and at the same time produce a clean drop.

According to a further aspect of the present invention, the circuit also includes means for indicating the level of current flow in the reverse direction through electromagnet 20. As illustrated in FIG. 1, an indicator light 130 is located in parallel with diode 58. This indicator light will become energized when the lift circuit is initiated to give an indication to the operator that the discharge circuit is functioning properly. The circuit for energizing indicator light 130 is through resistors 56, 54 and 52 and closed contacts 18 and 24.

Indicator light 130 can also be utilized to accurately adjust the resistance in adjustable resistor 76 to suit the conditions of the various components in the circuit to result in a most effective point of "drop-out" of the drop circuit for varying conditions. It will be appreciated that during the energization of the drop circuit, indicator light 130 can be utilized to accurately adjust the maximum value of reverse current flow by appropriate adjustment of resistor 76. This is accomplished by producing a balance of voltage drop or current flow across resistors 52, 54 and resistors 74 and 76.

Thus, the reverse current adjustment for resistor 76 can be set at a minimum value and increased in increments until the indicator light 130 starts to "blink" at the end of the drop cycle. This would establish the optimum reverse current flow through electromagnet 20 before control relay 72 becomes de-energized. If the reverse current adjustment is too high, indicator light 130 will glow brightly at the completion of the drop cycle to give an indication to the operator that the reverse current through electromagnet 20 is set too high.

Another feature incorporated into the circuit illustrated in the drawings is a mechanism for maintaining the voltage across diode 58 below a certain level to prevent destruction of the diode. As illustrated in FIG. 1, a suppressor 140 is connected in parallel across diode 58 to absorb some of the voltage drop across the diode during reverse current flow through electromagnet 20. If desired, an additional fixed resistor 142 could also be placed in parallel with diode or rectifier 58 with a set of normally closed contacts 144 that are opened by contactor 26 when the lifting circuit is completed. Thus, when the lifting circuit is interrupted, a parallel circuit is established across resistor 142 to further reduce the voltage drop across rectifier 58. An additional suppressor 150 could also be added in parallel with diode or rectifier 64, as a protective means.

Of course, numerous modifications come to mind without departing from the spirit of the invention. For example, resistors 74 and 142 could be eliminated for some conditions of operation where maximum residual potential is lower than that described above.

What is claimed:

1. Circuitry for controlling the operation of an electromagnet coupled to a source of voltage, said source having a predetermined potential for producing current flow through said electromagnet, said circuitry comprising a first circuit connectable to said source for producing current flow in one direction and develop a magnetic field in said electromagnet, a second circuit connectable to form a closed loop with said electromagnet and having impedance means for dissipating stored energy in said electromagnet, gate means between said source and said second circuit for connecting said source to said second circuit when the level of stored energy drops to the level of potential of said source to continue dissipation of stored energy, and to initiate a current flow in a relatively reverse direction through said magnet when the residual potential drops below a predetermined value, and a means of terminating the flow of reverse current after it has risen to a second predetermined value.

2. Circuitry as defined in claim 1, in which said predetermined value is approximately the applied potential of the source sand circuitry is readily adjustable so that at the termination of reverse current the residual magnetism of the magnet and load material attached thereto are approximately zero providing a clean drop of load material from the magnet.

3. Circuitry as defined in claim 1, in which said impedance means includes a plurality of resistors with said gate means connected between a first and a second of said resistors.

4. Circuitry as defined in claim 3, further including means in parallel with said first and second resistors for disconnecting said source from said second circuit when the level of potential in the reverse direction reaches a predetermined value.

5. Circuitry as defined in claim 4, in which said means in parallel with said first and second resistors includes manually variable impedance means for changing said predetermined value of potential in the reverse direction.

6. A circuit for controlling the operation of an electromagnet, comprising first and second conductors connected to a voltage source for producing current flow, a lifting circuit between said conductors having normally open contact means closeable to produce current flow in one direction through said magnet and develop potential in said electromagnet for a lifting operation, a second circuit connectable to said electromagnet to form a closed loop with said electromagnet to dissipate residual potential in said electromagnet when said contact means are opened with means for isolating said second circuit until the residual potential drops to the level of potential across said conductors, said second circuit including series connected fixed impedance means for dissipating said residual potential and for reversing current flow through said electromagnet and manually variable impedance means in parallel with at least one of said fixed impedance means, said manually variable impedance means defining the level of reverse potential through said electromagnet.

7. A circuit as defined in claim 6, in which said means for isolating said second circuit includes gate means between said first conductor and said second circuit limiting current flow from said first conductor to said second circuit.

8. A circuit as defined in claim 7, in which said fixed impedance means includes first, second and third fixed value resistors with said isolating means connected between said first and second resistors, and in which said manually variable impedance means is in parallel with said first and second resistors.

9. A circuit as defined in claim 8, in which said circuit includes a drop circuit, and in which said manually variable impedance means includes a manually variable resistor in series with a relay having normally open contacts in said drop circuit so that said drop circuit is de-energized when said relay becomes de-energized.

10. A circuit as defined in claim 6, further including indicator means for indicating the level of reverse current flow through said electromagnet.

11. A method of controlling the operation of an electromagnet comprising the steps of connecting a source of voltage to said electromagnet to produce current flow in one direction and develop a potential therein, disconnecting said source from said electromagnet and connecting a dissipating circuit to said electromagnet to continue current flow in said one direction and reduce the residual potential and voltage in said electromagnet, connecting said source to said dissipating circuit when the potential of said source equals the potential of said dissipating circuit to maintain the voltage across said electromagnet at an elevated value and continue reduction of said residual potential, reversing the current flow through said magnet when the residual potential therein drops to a predetermined value, and disconnecting said source from said dissipating circuit and electromagnet when the current flow in the reverse direction reaches a predetermined value.

12. A method as defined in claim 11, further including adjusting the predetermined value of reverse current flow by viewing an indicator means after the dissipating circuit is disconnected from said source.

* * * * *